United States Patent [19]

Kirschenbaum

[11] 4,430,837

[45] Feb. 14, 1984

[54] FASTENING ARRANGEMENT FOR ABUTTING STRUCTURAL MEMBERS

[75] Inventor: Bernard Kirschenbaum, Denver, Colo.

[73] Assignee: Bell Telephone Laboratories, Incorporated, Murray Hill, N.J.

[21] Appl. No.: 321,382

[22] Filed: Nov. 16, 1981

[51] Int. Cl.[3] ..... E04B 1/38; E01C 5/00

[52] U.S. Cl. ..... 52/506; 52/586; 52/512; 404/40

[58] Field of Search ..... 52/506, 513, 590, 564, 52/586, 591, 471, 509, 483, 137, 512, 235; 404/40

[56] References Cited

U.S. PATENT DOCUMENTS

| | | | |
|---|---|---|---|
| 886,077 | 4/1908 | Rowe | 404/40 |
| 1,436,896 | 11/1922 | Newell | 404/40 |
| 1,888,937 | 11/1932 | Saives | 404/40 |
| 2,549,534 | 4/1951 | Shultz | 280/11.13 |
| 2,895,753 | 7/1959 | Fentiman | 287/20.3 |
| 3,091,487 | 5/1963 | Gallagher | 287/130 |
| 3,160,245 | 12/1964 | Pavlecka | 52/586 |
| 3,160,249 | 12/1964 | Pavlecka | 52/586 |
| 3,469,865 | 9/1969 | Ellenburg | 285/330 |

FOREIGN PATENT DOCUMENTS

| | | | |
|---|---|---|---|
| 1438240 | 11/1966 | France | 404/40 |

*Primary Examiner*—John E. Murtagh
*Assistant Examiner*—Kathryn L. Ford
*Attorney, Agent, or Firm*—W. H. Kamstra

[57] ABSTRACT

A fastening arrangement for multiple sections of structural flooring and the like having contiguous corners (10*a*, 10*b*, 10*c*, 10*d*). The corner end of each section is grooved to present a sector (13) of a cylinder which when combined present a cylindrical bore at the junction of the section corners (10). At least the upper surface of each corner (10) has formed therein a dovetailed recess (15) which widens away from the corner junction point. A flat locking key washer member (17, 22) having dovetailed tabs (20) is fitted into the recesses (15, 15') maintains the contiguous corners (10) in place and a bolt (21) passing through a central aperture (18) of member (17) and to the cylindrical bore presented at the corners (10) may be employed to secure the assembly to a supporting structure (11).

11 Claims, 5 Drawing Figures

FIG. 2
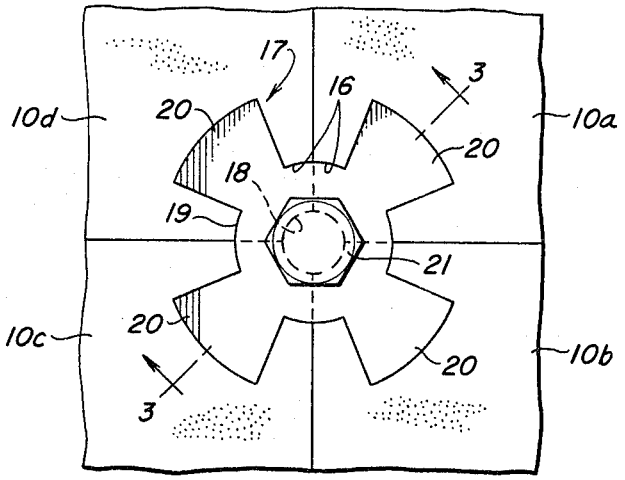
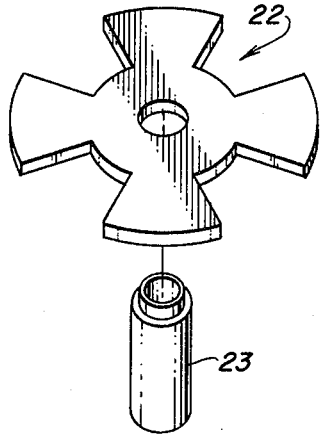
FIG. 4
FIG. 3
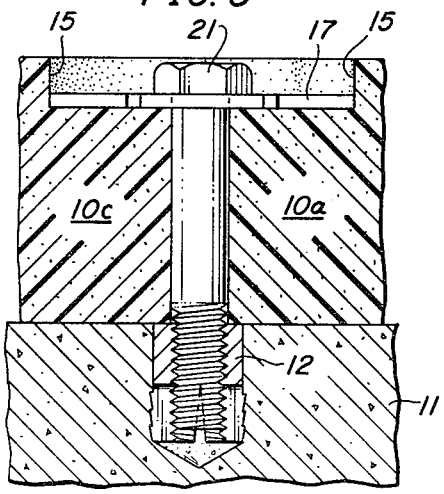
FIG. 5
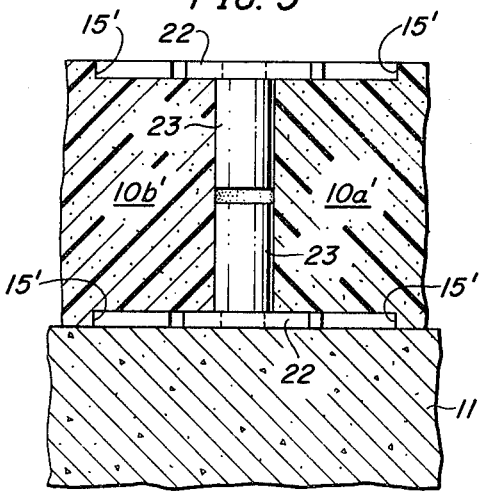

FASTENING ARRANGEMENT FOR ABUTTING STRUCTURAL MEMBERS

TECHNICAL FIELD

This invention relates to arrangements for fastening contiguous structural members and more particularly to such arrangements for fastening together planar members such as flooring and the like.

BACKGROUND OF THE INVENTION

The fabrication of large expanses of flat decking or flooring by fitting together a number of rectangular modular sections is well-known in the construction art. When contiguously fitted together, each corner of each of the equally dimensioned sections meets the corners of three adjoining such sections. At these meeting points, each of the corners is conventionally secured to the others and frequently to a supporting structure or subfloor in order to prevent separation of the sections and to maintain them in place. One known manner of fastening the modular sections together, for example, has been to bolt each corner to its supporting structure. This necessarily involves the provision of four holes and four bolts for each junction of the modular section corners. Further, threaded holes must be provided in the supporting structure which precisely align with the holes in the section corners to ensure that the sections are accurately fitted together. If even one of the latter holes is slightly out of alignment, not only will the snug fitting of that corner be prevented, but the holes at the other corners of the same section will be thrown out of alignment as well. Any mechanical arrangement for individually securing the modular section corners, thus, in many cases presents the problems of alignment, the necessity for providing multiple fastening devices, and the time and care, and thus, the expense of achieving accurately fitting corner junctions. It is accordingly an objective of the present invention to provide a simplified modular planar section fastening arrangement which requires fewer parts, ensures a more accurate fit, requires less fabrication time, and realizes significant cost savings.

SUMMARY OF THE INVENTION

The foregoing and other objectives are realized in one illustrative fastener arrangement for multiple modular planar sections according to the invention in which the corners of the equally dimensioned sections are formed to present sectors of a cylinder. As a result, when a corner so formed of four rectangular sections is fitted into abutment with the others, a cylindrical bore is presented having its axis perpendicular to the planes of the modular sections. The surfaces of the corners have dovetail recesses formed therein, which recesses widen in width from the axis of the cylindrical bore along extended radii thereof. When corners of four modular sections are fitted into abutment, a key washer element having dovetail tabs is fitted into the recesses at the corner junction. With all the corner junctions of the modular sections of an expanse of flooring so fitted, the individual sections, without more, are secured against lateral displacement. The sections may be additionally secured to a supporting structure or subfloor by means of bolts passed through central apertures of the key washers and the cylindrical bores.

BRIEF DESCRIPTION OF THE DRAWING

The organization of a modular section fastening arrangement for an expanse of flooring according to the principles of the invention, together with its features will be better understood from a consideration of the detailed description of one illustrative embodiment thereof which follows when taken in conjunction with the accompanying drawing in which:

FIG. 2 is a plan view of the assembly of the element of FIG. 1 including corner portions of the four modular flooring sections;

FIG. 3 is a section view of the assembly of FIG. 2 taken along the line 3—3 in the direction indicated, the assembly being shown as secured to a concrete subfloor;

FIG. 4 depicts in exploded, perspective view an alternate key washer element according to the invention; and FIG. 5 is a section view of an assembly substantially similar to that of FIG. 3 in which the key element of FIG. 4 is substituted for the key arrangement of FIG. 3.

DETAILED DESCRIPTION

Figure 1:
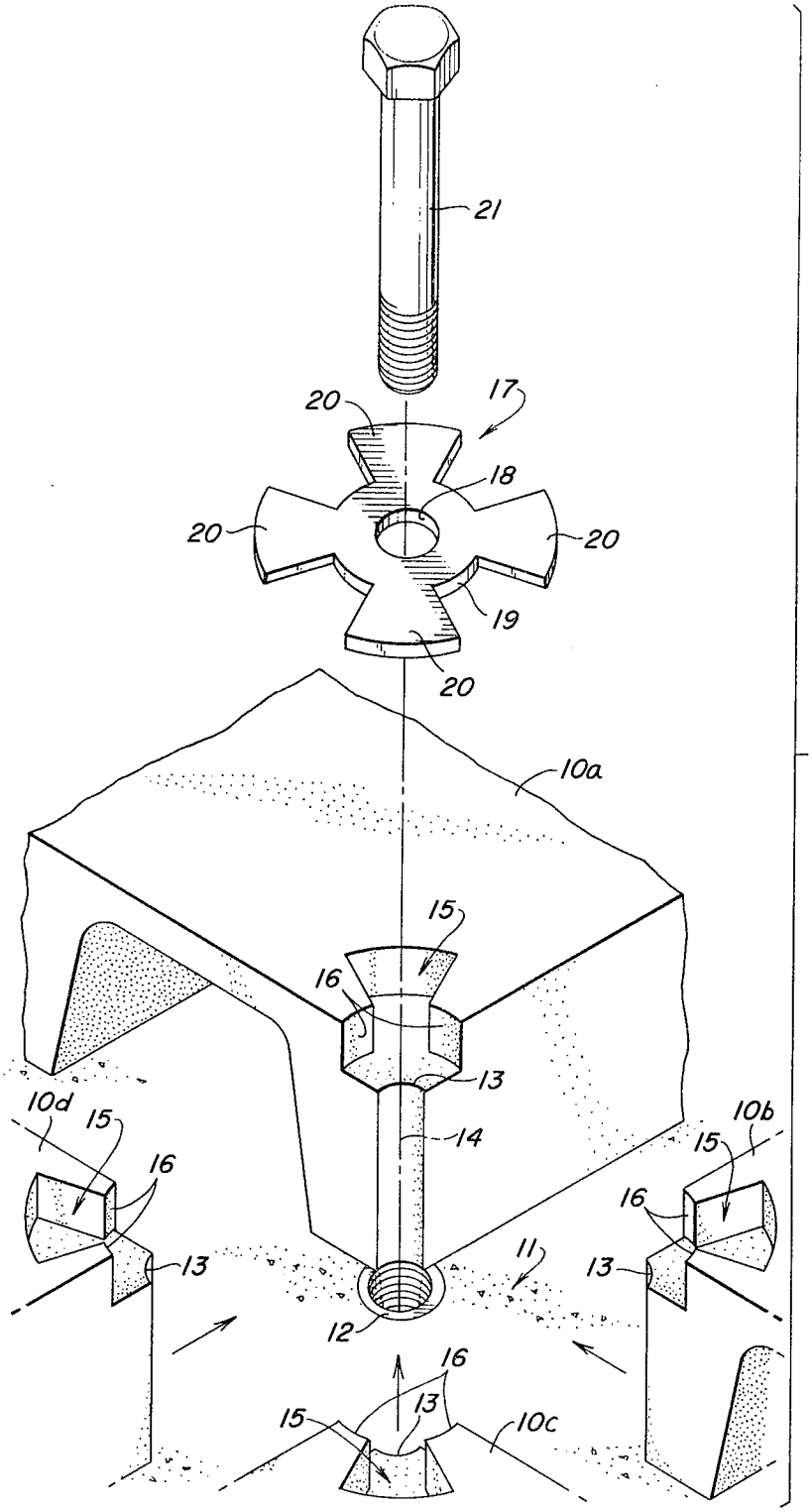
FIG. 1 is an exploded, unassembled view in perspective of the elements of one illustrative fastening arrangement according to the invention including corner portions of four modular flooring sections.

Equally dimensioned rectangular modular flooring sections with which the fastening arrangement of the invention is contemplated for use are formed to present a top bearing surface and four perpendicular sides meeting at axes at right angles to the bearing surface. The flooring sections may be cavitated to save weight and material or for other purposes and may be formed of any suitable material such as structural foam plastic, for example. The corner portions 10*a*, 10*b*, 10*c*, and 10*d* of four modular sections are shown in FIG. 1 preparatory to their being fitted together, the sections here being supported by a concrete subfloor 11. Corner portion 10*a* is shown in its final place at a tapped anchor 12 sunk in subfloor 11. Each corner of each of the floor sections is grooved at the junction of two perpendicular sides to present a 90 degree sector 13 of a cylindrical bore coaxial with the former meeting axis 14 of the two sides.

The top surfaces of the corner portions 10*a*, 10*b*, 10*c*, and 10*d* have recesses 15 formed therein to present 90 degree sectors of a cylinder coaxial with axis 14 having side-walls 16 perpendicular to the planar surfaces of the corner portions. Recesses 15 are further formed to present dovetail openings lying along radii extending from axis 14 substantially at 45 degrees from the sides of the floor sections, the dovetails openings widening uniformly outwardly from axis 14 and having walls perpendicular to the planar surfaces of the corner portions. The illustrative fastening arrangement being described also comprises a flat key washer member 17 shown in FIG. 1 as having a central aperture 18 and a central washer section 19 having four dovetailed tabs 20 extending therefrom at 90 degree spacings. Each of 90 degree sectors of central washer section 19 including a tab 20 is formed and dimensioned to fit snugly in a recess 15 of corner portions 10*a*, 10*b*, 10*c*, and 10*d*. When the latter corner portions are fitted into abutment as shown in the plan view of FIG. 2, key washer member 17 is fitted into the corresponding single recess formed by the combined recesses 15. As is apparent from FIG. 2, dovetailed tabs 20 effectively maintain the corner portions in abutment. When the other eight corners of the modular floor sections of which corner portions 10*a*, 10*b*, 10*c*, and 10*d* are part, are similarly fastened, the floor sections are prevented from any lateral movement relative to each other. If requirements dictate that the modular flooring also be fastened to a supporting structure, such as a concrete subfloor, for example, a bolt 21 (FIGS. 1 and 3) is provided for each corner junction having threads fitting the threads of anchor 12 sunk in concrete subfloor 11. Bolt 21 is of a diameter to pass freely through aperture 18 of member 17 and the cylindrical bore formed by the corners of the modular floor sections. The depth of recesses 15 may be determined so that the head of bolt 21 is below the surface of the flooring if required.

In another illustrative embodiment of a fastening arrangement according to the invention shown in FIGS. 4 and 5, the corner portions of the modular floor sections have recesses 15' formed on both the upper and lower surfaces. Recesses 15' are identical in configuration to the recesses 15 of the embodiment of FIGS. 1–3 and the corner portions are similarly grooved with sectors of a cylinder. In this embodiment, a flat key washer element 22 having a configuration identical to that of member 17 has centrally extending therefrom on one side a cylindrical stem 23. Stem 23 may be integrally formed with washer element 22 or it may be fitted thereto as shown in the exploded view of FIG. 4. When the corner portions of four modular floor sections are fitted into abutment (see representative corner portions 10*a'*, and 10*b'* in FIG. 5), a stem 23 and key member 22 is fitted into the underside of the corner junction and another such key member assembly is fitted into the top side of the corner junction. The depth of recesses 15' may be determined so that both upper and lower surfaces of the corner portions will be flush and the thickness of members 22 and the length of sleeve 23 are determined so that the latter element extends just short of the midpoint of the thickness of the modular floor sections corner portions. Where the surface of the supporting structure 11 is uneven, both of the fastening arrangements described in the foregoing may be suitably shimmed to achieve and even planar flooring surface.

Although the fastening arrangement of the invention has been described in the foregoing in connection with modular flooring sections having right angle corners, the arrangement may advantageously be employed to fasten together sections having corners having angles greater or less than 90 degrees. The fastening arrangement may thus be readily adapted to fasten together flooring or other structural sections at their abutting sides rather than at the corner junctions. In the latter case, the key washer member would have two dovetailed tabs at 180 degree spacing; for corner junctions of sections having 120 degree corners, the key member would have three dovetailed tabs at 120 degree spacing; for 60 drgree corners, the key member would have six tabs at 60 degree spacings, etc.

What have been described are thus considered to be only specific illustrative fastening arrangements according to the principles of the invention. Accordingly, it is to be understood that various and numerous other arrangements may be divised by one skilled in the art without departing from the spirit and scope of the invention as limited only by the accompanying claims.

What is claimed is:

1. A fastening arrangement for joining a plurality of structural floor section members having contiguous top bearing surfaces at corner portions (10*a*, 10*b*, 10*c*, 10*d*) thereof, and each of said floor section members having plane side faces substantially perpendicular to said top bearing surface said corner portions extending radically from a common axis substantially perpendicular to said top bearing surface (14), characterized in that each of said corner portions (10*a*, etc.) has a first dovetailed recess (15) formed in one surface thereof extending along a radius from said common axis (14), said recess (15) being formed to increase in width along said radius, that each of said corner portions (10*a*, etc.) is further grooved parallel to said common axis (14) to present a cylindrical bore coaxial with said common axis, and in a key washer member (22) having a plurality of dovetailed tabs formed to fit, respectively, said recesses (15) of said plurality of corner portions (10*a*, etc.) and a cylindrical stem (23) extending centrally from said member (22) dimensioned to fit said cylindrical bore.

2. A structural member for a floor section having a corner having a top bearing surface adapted to be fitted in contiguous abutment with the surfaces adapted of the corners of like other structural members, and having plane side faces substantially perpendicular to said top bearing surface, said corner having a dovetailed recess formed in said surface, said recess being formed to increase in width inwardly from said corner, said recess being adapted to receive a corresponding dovetailed tab of a key washer member, said corner further having a groove presenting a sector of a cylinder substantially perpendicular to said top bearing surface, said groove comprising a portion of the wall of a cylindrical bore when said corner surface is fitted in contiguous abutment with the surfaces of the corners of like other structural members.

3. A fastening arrangement for a floor section for joining a plurality of structural members having contiguous top bearing floor surfaces at corner portions (10*a*, 10*b*, 10*c*, 10*d*) thereof, each of said structural members having plane side faces substantially perpendicular to said top bearing floor surfaces, said corner portions extending radially from a common axis (14), characterized in that each of said corner portions (10*a*, etc.) has a dovetailed recess (15) formed in a surface thereof extending along a radius from said common axis (14), said recess (15) being formed to increase in width along said radius, and in a key washer member (17, 22) having a plurality of dovetailed tabs (20) formed to fit, respectively, said recesses (15) of said plurality of corner portions (10*a*, etc.), and in that said corner portions (10*a*, etc.) are grooved parallel to said common axis (14) to present a cylindrical bore coaxial with said common axis and substantially perpendicular to said top bearing surface, said key washer member (17) having an aperture (18) coaxial with said common axis, and in retaining means comprising bolt means (21) extending through said aperture (18) and said bore for fastening said structural members to a supporting structure (11).

4. A fastening arrangement for joining a first and a second structural member for a floor section each of said structural members having a top bearing surface abutting at an edge of the other surface plane side surfaces to which it is substantially perpendicular, characterized in that each of said members has a dovetailed recess formed in a said top bearing surface opening to said edge, said recess being formed to increase in width in a direction inwardly from said edge, in a key washer member having a first and a second dovetailed tab formed to fit, respectively, said recess of said first and second structural member, in that each of said first and second structural member is grooved to present a portion of the wall of a cylindrical bore substantially perpendicular to said sruface and opening on said recess, in that said key washer member has an aperture therein coaxial with said bore, and in retaining means comprising bolt means extending through said aperture and said bore for fastening said first and second structural members to a supporting structure.

5. A fastening arrangement as claimed in claim 1 further characterized in that each of said corner portions (10*a*, etc.) has a second dovetailed recess (15) formed in an opposite surface thereof extending along a radius from said common axis (14), said recess (15) also being formed to increase in width along said radius, and in a key washer member (22) having a plurality of dovetailed tabs formed to fit, respectively, said second recesses (15) and a cylindrical stem (23) extending centrally from said member (22) dimensioned to fit said cylindrical bore from said opposite surface.

6. A fastening arrangement as claimed in claim 5 or 1 further characterized in that each of said recesses (15) also has a circular section presenting a pair of circular faces (16) coaxial with said common axis (14) and in that said key washer member (22) has a circular central portion dimensioned to fit within said circular faces (16).

7. A fastening arrangement as claimed in claims 5, 1, or 3 further characterized in that said corner portions (10*a*, 10*b*, 10*c*, 10*d*) present 90 degree angles.

8. A structural member as claimed in claim 2 in which said recess also has a circular section presenting a pair of circular faces, said faces being adapted to partially enclose a corresponding central portion of said key washer member.

9. A structural member as claimed in claim 2 in which said corner presents a 90 degree angle.

10. A fastening arrangement as claimed in claim 3 further characterized in that said recesses (15) each also has a circular section presenting a pair of circular faces (16) coaxial with said common axis (14) and in that said key washer member (17) has a circular central portion (19) dimensioned to fit within said circular faces (16).

11. A fastening arrangement as claimed in claim 4 further characterized in that each of said recesses also has a circular section presenting a pair of circular faces coaxial with said bore and in that said key washer member has a circular center portion dimensioned to fit within said circular faces.

* * * * *